US010078962B1

(12) United States Patent
Epperlein et al.

(10) Patent No.: US 10,078,962 B1
(45) Date of Patent: Sep. 18, 2018

(54) IDENTIFICATION AND CONTROL OF TRAFFIC AT ONE OR MORE TRAFFIC JUNCTIONS

(71) Applicant: International Business Machines Corporation, Armonk, NY (US)

(72) Inventors: Jonathan Epperlein, Dublin (IE); Jakub Marecek, Dublin (IE); Rahul Nair, Dublin (IE)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 0 days.

(21) Appl. No.: 15/581,918

(22) Filed: Apr. 28, 2017

(51) Int. Cl.
*G08G 1/07* (2006.01)
*G08G 1/083* (2006.01)

(52) U.S. Cl.
CPC ..... *G08G 1/083* (2013.01)

(58) Field of Classification Search
None
See application file for complete search history.

(56) References Cited

U.S. PATENT DOCUMENTS 976,939 A 11/1910 Sirrine
3,209,325 A 9/1965 Mentzer et al.
3,233,217 A 2/1966 Bost, Jr.
3,247,482 A 4/1966 Lesher
3,412,378 A 11/1968 Thomas
3,641,486 A * 2/1972 Brockett ..... G08G 1/082 340/913
3,660,811 A 5/1972 Vail et al.
3,673,560 A 6/1972 Barsh et al.
3,710,313 A 1/1973 Kimball et al.
3,784,970 A 1/1974 Simpkin
3,859,623 A 1/1975 Koehler
3,876,940 A 4/1975 Wickford et al.
3,949,300 A 4/1976 Sadler
4,013,994 A 3/1977 Ragano et al.
4,016,532 A 4/1977 Rose
4,158,190 A 6/1979 Stefanov
4,209,769 A 6/1980 Chronerberry
4,212,085 A 7/1980 Vaillancour et al.
4,228,419 A 10/1980 Anderson
4,234,967 A 11/1980 Henschel
4,238,778 A 12/1980 Ohsumi
(Continued)

OTHER PUBLICATIONS

Cartner et al., Optimization of traffic signal settings by mixed-integer linear programming, Technical Report No. 91, Mar. 1974, 133 pages, Cambridge, Massachusetts.
(Continued)

*Primary Examiner* — Curtis King
(74) *Attorney, Agent, or Firm* — Amin, Turocy & Watson, LLP

(57) ABSTRACT

Techniques for autonomously optimizing traffic flow amongst one or more traffic junctions are provided. In one example, a computer-implemented method can comprise generating, by a system operatively coupled to a processor, a piece-wise sinusoidal representation of traffic arrival at a first traffic junction. The computer-implemented method can also comprise determining, by the system, an offset a parameter of one or more traffic junctions based on the piece-wise sinusoidal representation and a polynomial objective.

12 Claims, 10 Drawing Sheets

(56) References Cited

U.S. PATENT DOCUMENTS

| | | | | |
|---|---|---|---|---|
| 4,380,004 | A | 4/1983 | Coats et al. | |
| 4,403,208 | A | 9/1983 | Hodgson et al. | |
| 4,443,790 | A | 4/1984 | Bishop | |
| 4,463,339 | A | 7/1984 | Frick et al. | |
| 4,573,049 | A * | 2/1986 | Obeck | G08G 1/087 340/12.5 |
| 4,587,522 | A | 5/1986 | Warren | |
| 4,704,610 | A | 11/1987 | Smith et al. | |
| 4,764,978 | A | 8/1988 | Argo et al. | |
| 4,775,865 | A | 10/1988 | Smith et al. | |
| 4,794,394 | A | 12/1988 | Halstead | |
| 4,914,434 | A | 4/1990 | Morgan et al. | |
| 4,952,931 | A | 8/1990 | Serageldin et al. | |
| 5,014,052 | A | 5/1991 | Obeck | |
| 5,083,125 | A | 1/1992 | Brown et al. | |
| 5,126,735 | A | 6/1992 | Trevijano | |
| 5,187,373 | A | 2/1993 | Gregori | |
| 5,235,329 | A | 8/1993 | Jackson | |
| 5,278,553 | A | 1/1994 | Cornett et al. | |
| 5,289,181 | A | 2/1994 | Watanabe et al. | |
| 5,303,259 | A | 4/1994 | Loveall | |
| 5,307,060 | A | 4/1994 | Prevulsky et al. | |
| 5,345,232 | A | 9/1994 | Robertson | |
| 5,387,909 | A * | 2/1995 | Neel | G08G 1/097 315/130 |
| 5,495,243 | A | 2/1996 | McKenna | |
| 5,519,692 | A * | 5/1996 | Hershey | H04B 1/69 370/210 |
| 5,539,398 | A | 7/1996 | Hall | |
| 5,572,201 | A | 11/1996 | Graham et al. | |
| 5,574,469 | A | 11/1996 | Hsu | |
| 5,620,155 | A | 4/1997 | Michalek | |
| 5,739,767 | A | 4/1998 | Carr | |
| 5,863,203 | A | 1/1999 | Bragdon | |
| 5,889,475 | A | 3/1999 | Klosinski et al. | |
| 5,926,112 | A | 7/1999 | Hartzell | |
| 5,926,113 | A | 7/1999 | Jones et al. | |
| 5,955,968 | A | 9/1999 | Bentrott et al. | |
| 5,977,883 | A | 11/1999 | Leonard et al. | |
| 6,011,492 | A | 1/2000 | Garesche | |
| 6,064,319 | A * | 5/2000 | Matta | G08G 1/07 340/902 |
| 6,087,961 | A | 7/2000 | Markow | |
| 6,160,493 | A | 12/2000 | Smith | |
| 6,317,058 | B1 * | 11/2001 | Lemelson | G08G 1/07 340/905 |
| 6,445,308 | B1 | 9/2002 | Koike | |
| 6,587,778 | B2 | 7/2003 | Stallard et al. | |
| 6,587,781 | B2 * | 7/2003 | Feldman | G08G 1/0104 340/909 |
| 7,155,376 | B2 | 12/2006 | Yang et al. | |
| 7,617,042 | B2 * | 11/2009 | Horvitz | H04W 4/027 340/901 |
| 8,275,540 | B2 | 9/2012 | Downs | |
| 8,326,580 | B2 * | 12/2012 | Blu | G06F 17/10 375/316 |
| 8,433,505 | B2 | 4/2013 | Rogers | |
| 8,626,433 | B2 * | 1/2014 | Horvitz | H04W 4/027 180/272 |
| 9,076,332 | B2 | 7/2015 | Myr | |
| 2002/0008637 | A1 * | 1/2002 | Lemelson | G08G 1/07 340/907 |
| 2002/0062190 | A1 * | 5/2002 | Hameleers | G08G 1/09 701/117 |
| 2004/0233846 | A1 * | 11/2004 | Khandani | H04L 47/10 370/235 |
| 2010/0164753 | A1 * | 7/2010 | Free | G08G 1/096725 340/932 |
| 2011/0043378 | A1 * | 2/2011 | Bailey | G08G 1/07 340/917 |
| 2011/0273568 | A1 | 11/2011 | Lagassey | |
| 2013/0006722 | A1 | 1/2013 | Ziomkowski et al. | |
| 2013/0194922 | A1 | 8/2013 | Sukonik et al. | |
| 2014/0375475 | A1 * | 12/2014 | Wongpiromsarn | G08G 1/083 340/907 |
| 2015/0088406 | A1 | 3/2015 | Blandin | |
| 2015/0339919 | A1 * | 11/2015 | Barnett | G08G 1/0116 340/907 |
| 2016/0171887 | A1 | 6/2016 | Blandin et al. | |
| 2017/0180050 | A1 * | 6/2017 | Littlewood | H04J 14/0227 |

OTHER PUBLICATIONS

Acebrón et al., The Kuramoto model: A simple paradigm for synchronization phenomena, Reviews of Modern Physics, Jan. 2005, 117 pages.

Laurent et al., Chapter Two: The Approach of Moments for Polynomial Equations, Handbook on Semidefinite, Conic and Polynomial Optimization. International Series in Operations Research & Management Science, 2012, pp. 25-60, Springer-Verlag.

Arandia-Perez et al., Modeling automatic meter reading water demands as nonhomogeneous point processes, Journal of Water Resources Planning and Management, 2012, pp. 55-64, 140(1).

Baillieul et al., Geometric critical point analysis of lossless power system models, IEEE Transactions on Circuits and Systems, Nov. 1982, pp. 724-737, 29(11).

Berent et al., Sampling piecewise sinusoidal signals with finite rate of innovation methods, IEEE Transactions on Signal Processing, Feb. 2010, pp. 613-625, 58(2).

Cascetta et al., Models and algorithms for the optimization of signal settings on urban networks with stochastic assignment models, Annals of Operations Research, May 24, 2006, pp. 301-328, 144(1).

Coogan et al., Offset optimization for a network of signalized intersections via semidefinite relaxation, In Proceedings of the 54th IEEE Conference on Decision and Control, 2015, 6 Pages.

Dragotti et al., Sampling moments and reconstructing signals of finite rate of innovation: Shannon meets strang-fix, IEEE Transactions on Signal Processing, May 2007, pp. 1741-1757, 55(5).

Ghaddar et al., Optimal power flow as a polynomial optimization problem, IBM Search Report, Apr. 14, 2014, 9 Pages.

Harrison et al., Reflected brownian motion on an orthant, The Annals of Probability, Apr. 1981, pp. 302-308, 9(2).

Henry et al., The prodyn real time traffic algorithm, In Proceedings of the 4th IFAC/IFORS Conference on Control in Transportation Systems, Jan. 1984, pp. 305-310.

Robertson et al., Optimizing networks of traffic signals in real time—the SCOOT method, IEEE Transactions on Vehicular Technology, Feb. 1991, pp. 11-15, 40(1).

Jeyaku Mar et al., Convergent Semidefinite Programming Relaxations for Global Bilevel Polynomial Optimization Problems, SIAM Journal on Optimization, Society for Industrial and Applied Mathematics, 2016, pp. 753-780, 26(1).

Kojima et al., A Note on Sparse SOS and SDP Relaxations for Polynomial Optimization Problems Over Symmetric Cones. Computational Optimization and Applications, 2009, pp. 31-41, 42(1).

Kouvelas et al., Maximum Pressure Controller for Stabilizing Queues in Signalized Arterial Networks, Transportation Research Record: Journal of the Transportation Research Board, 2014, pp. 133-141, (2421), Washington D.C.

Kuhl et al., Estimating and Simulating Poisson Processes Having Trends or Multiple Periodicities, Sep. 10, 1996, 28 Pages.

Lämmer et al., Self-control of traffic lights and vehicle flows in urban road networks, Journal of Statistical Mechanics: Theory and Experiment, Apr. 2008, 34 Pages, P04019.

Lämmer et al., Decentralised control of material or traffic flows in networks using phase-synchronisation, Physica A: Statistical Mechanics and its Applications, Information and Material Flows in Complex Networks Information and Material Flows in Complex Networks, Mar. 30, 2006, pp. 39-47, 363(1).

Lasserre et al., Convergent SDP-Relaxations in Polynomial Optimization with Sparsity, Apr. 12, 2006, 22 Pages.

Akçelik et al., An evaluation of SCATS Master Isolated control, in Proceedings of the 19th ARRB Transport Research Conference (Transport 98) (CD), 1998, pp. 1-24, ARRB Transport Research Ltd, Vermont South, Australia.

(56) References Cited

OTHER PUBLICATIONS

Mehta et al., Algebraic geometrization of the kuramoto model: Equilibria and stability analysis, Chaos, 2015, 7 Pages, 25(5).
Miller. Settings for Fixed-Cycle Traffic Signals, Operational Research Quarterly, Dec. 1963, pp. 373-386, 14(4).
Mirchandani et al., A real-time traffic signal control system: architecture, algorithms, and analysis, Transportation Research Part C: Emerging Technologies, 2001, pp. 415-432, 9(6).
Muralidharan, et al., Analysis of fixed-time control, Nov. 4, 2014, 14 Pages.
Piera et al., On Product-Form Stationary Distributions for Reflected Diffusions with Jumps in the Positive Orthant, Advances in Applied Probability, 2005, pp. 212-228.
Sekiyama et al., Self-Organizing control of urban traffic signal network, IEEE International Conference on in Systems, Man, and Cybernetics, 2001, pp. 2481-2486, vol. 4.
Smith et al., Smart Urban Signal Networks: Initial application of the Surtrac Adaptive Traffic Signal Control System, in Proceedings of the Twenty-Third International Conference on Automated Planning and Scheduling, 2013, pp. 434-442.
Tassiulas et al., Stability Properties of Constrained Queueing Systems and Scheduling Policies for Maximum Throughput in Multihop Radio Networks, IEEE Transactions on Automatic Control, Dec. 1992, pp. 1936-1948, 37(12).
Morris et al., HCM 2010 Highway Capacity Manual, Chapter 31, Signalized Intersections: Supplemental, 2010, pp. 1-127, vol. 4, Transportation Research Board of the National Academies, Washington, DC.
Varaiya, Max pressure control of a network of signalized intersections, Transportation Research Part C: Emerging Technologies, 2013, pp. 177-195, 36.
Whitt, The Reflection Map with Discontinuities, Mathematics of Operations Research, 2001 pp. 447-484, 26.
Wongpiromsarn et al., Distributed Traffic Signal Control for Maximum Network Throughput, In 2012 15th International IEEE Conference on Intelligent Transportation Systems, Institute of Electrical and Electronics Engineers, 2012, pp. 588-595.
Office Action for U.S. Appl. No. 15/842,702 dated Jan. 24, 2018, 60 pages.

* cited by examiner

IDENTIFICATION AND CONTROL OF TRAFFIC AT ONE OR MORE TRAFFIC JUNCTIONS

STATEMENT REGARDING FEDERALLY SPONSORED RESEARCH OR DEVELOPMENT

The project leading to this application has received funding from the European Union's Horizon 2020 research and innovation programme under grant agreement no. 688380.

BACKGROUND

The subject disclosure relates to traffic control, and more specifically, to identifying and optimizing phase sequences in one or more traffic junctions.

SUMMARY

The following presents a summary to provide a basic understanding of one or more embodiments of the invention. This summary is not intended to identify key or critical elements, or delineate any scope of the particular embodiments or any scope of the claims. Its sole purpose is to present concepts in a simplified form as a prelude to the more detailed description that is presented later. In one or more embodiments described herein, systems, computer-implemented methods, apparatuses and/or computer program products that can identifying and optimizing phase sequences in one or more traffic junctions are described.

According to an embodiment, a computer-implemented method is provided. The computer-implemented method can comprise generating, by a system operatively coupled to a processor, a piece-wise sinusoidal representation of a traffic arrival at a first traffic junction. The computer-implemented method can also comprise determining, by the system, a parameter of one or more traffic junctions based on the piece-wise sinusoidal representation and a polynomial objective.

According to another embodiment, a system is provided. The system can comprise a memory that stores computer executable components. The system can also comprise a processor, operably coupled to the memory, and that executes the computer executable components stored in the memory. The computer executable components can comprise a polynomial component that can generate a piece-wise sinusoidal representation of traffic arriving at a first traffic junction. Further the computer executable components can comprise an optimization component that can determine an offset between a start of a first phase sequence of the first traffic junction and a start of a second phase sequence of a second traffic junction based on the piece-wise sinusoidal representation.

According to another embodiment, a computer program product is provided. The computer product can facilitate controlling traffic. The computer program product can comprise a computer readable storage medium having program instructions embodied therewith. The program instructions can be executable by a processor to cause the processor to generate a piece-wise sinusoidal representation of traffic arrival at a first traffic junction. Further, the program instructions can cause the processor to determine an offset between a first parameter of the first traffic junction and a second parameter of a second traffic junction based on the multivariate polynomial.

DETAILED DESCRIPTION

Figure 1:
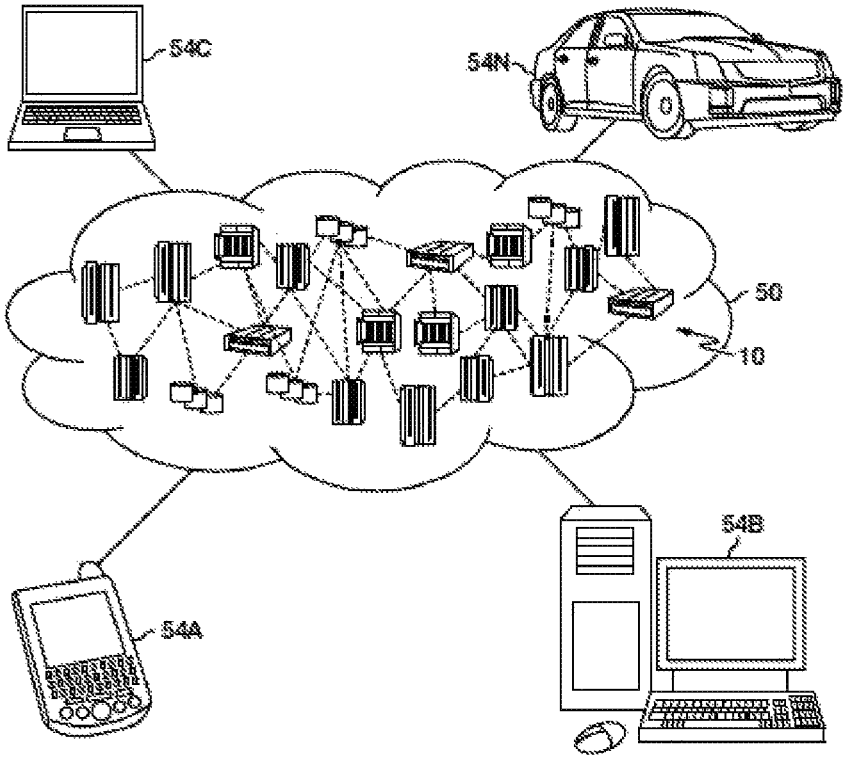
FIG. 1 depicts a cloud computing environment in accordance with one or more embodiments described herein.

The following detailed description is merely illustrative and is not intended to limit embodiments and/or application or uses of embodiments. Furthermore, there is no intention to be bound by any expressed or implied information presented in the preceding Background or Summary sections, or in the Detailed Description section.

One or more embodiments are now described with reference to the drawings, wherein like referenced numerals are used to refer to like elements throughout. In the following description, for purposes of explanation, numerous specific details are set forth in order to provide a more thorough understanding of the one or more embodiments. It is evident, however, in various cases, that the one or more embodiments can be practiced without these specific details.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
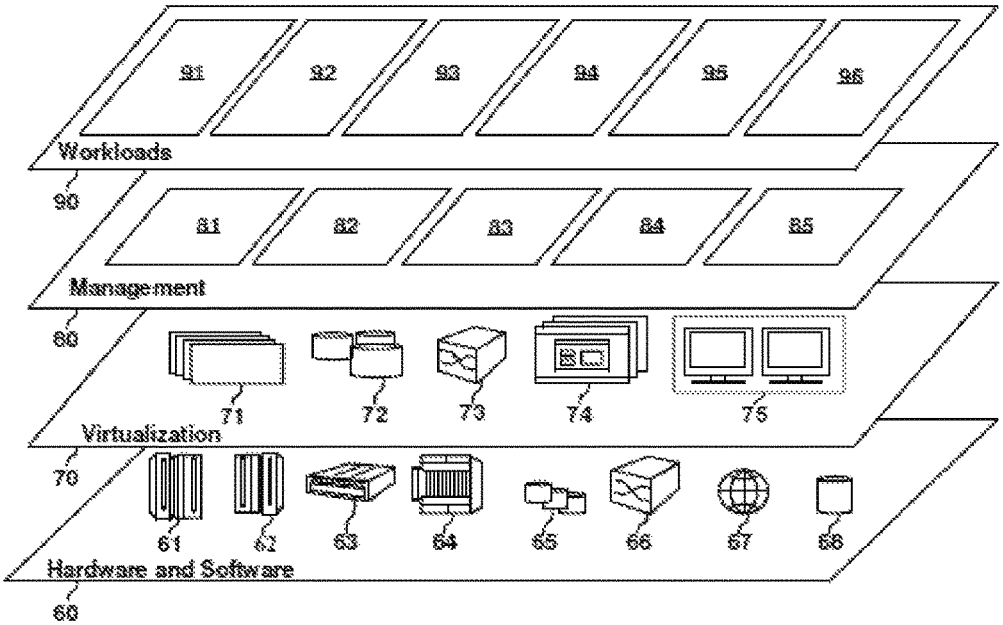
FIG. 2 depicts abstraction model layers in accordance with one or more embodiments described herein.

Referring now to FIG. 2, a set of functional abstraction layers provided by cloud computing environment 50 (FIG. 1) is shown. Repetitive description of like elements employed in other embodiments described herein is omitted for sake of brevity. It should be understood in advance that the components, layers, and functions shown in FIG. 2 are intended to be illustrative only and embodiments of the invention are not limited thereto. As depicted, the following layers and corresponding functions are provided. Repetitive description of like elements employed in other embodiments described herein is omitted for sake of brevity.

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and traffic controlling 96. Various embodiments described herein can utilize the cloud computing environment described with reference to FIGS. 1 and 2 to identify and optimize phase sequences in one or more traffic junctions in order to facilitate traffic control.

Throughout the world, road congestion can be a substantial negative externality on both individuals and community infrastructures. For example, the Centre for Economics and Business Research and INRIX estimates that the cost of traffic congestion in the UK, France, Germany, and the USA alone runs at $200 billion annually. Often traffic control systems are utilized to reduce traffic congestion on the roadways. However, conventional traffic control systems are not customized for the specific traffic parameters of a particular traffic intersection and provide minimal to no consideration of an offset between multiple traffic intersections in congested conditions. For example, conventional traffic control systems do not account for an effect of queue spillback or consider how demand starvation at one traffic intersection can effect another traffic intersection.

Various embodiments of the present invention can be directed to computer processing systems, computer-implemented methods, apparatus and/or computer program products that facilitate the efficient, effective, and autonomous (e.g., without direct human guidance) identification of traffic parameters and optimization of traffic flow at one or more traffic junctions. One or more embodiments described herein can model exogenous arrivals and departures of various traffic types at one or more traffic junctions as piece-wise sinusoidal projections and optimize an offset between phase sequences of traffic junctions. Furthermore, various embodiments described herein can comprise computer-implemented methods, systems, and computer products to facilitate autonomous control of heterogeneous traffic across one or more traffic junctions. One or more embodiments of the present invention can optimize traffic flow across one or more traffic junctions based on customizable priority schemes and can consider traffic-adaptive turn ratios (e.g., the percentage of traffic turning left, turning right, or proceeding straight at a traffic junction).

For example, various embodiments can comprise: generating a continuous traffic flow profile from discrete data and/or aggregate data for a traffic junction; generating a multivariate polynomial, which can be based on the continuous traffic flow profile, that can represent amplitude and time change of traffic flow at the traffic junction; and optimizing offsets between the phase sequences of one or more traffic junctions based on the multivariate polynomial.

As used herein "traffic route" can refer to a designated transportation area that can be utilized to facilitate travel from one destination to another destination. Example, traffic routes can include, but are not limited to: roadways, streets, trails, water-ways, and/or sidewalks. Also, as used herein "traffic" can refer to individuals traveling along a traffic route (e.g. pedestrians) and/or vehicles (cars, trains, trams, bicycles, buses, trolleys, and/or boats), motorized or otherwise powered, that facilitate the transportation of individuals along a traffic route. Further, as used herein "traffic junction" can refer to a meeting of two or more traffic routes. Example traffic junctions can include, but are not limited to: an intersection of roadways wherein traffic guidance devices (e.g., one or more traffic lights) control the flow of traffic across a junction formed by the merger of the roadways; and pedestrian cross-walks that traverse roadway intersections and/or mergers.

The computer processing systems, computer-implemented methods, apparatus and/or computer program products employ hardware and/or software to solve problems that are highly technical in nature (e.g., generating piece-wise sinusoidal representations of traffic flows and generating control directives to optimize said traffic flows by varying offsets between the traffic junctions based on a multivariate polynomial that suggests priorities), that are not abstract and cannot be performed as a set of mental acts by a human. The optimization of traffic flow at a traffic junction is complex and can change rapidly based on varying traffic parameters (e.g., amount of traffic and/or type of traffic and/or times of day that experience heavy or light traffic flow) and/or priorities (e.g., prioritization of traffic and/or special events occurring in proximity to the traffic junction). Traffic flow optimization further increases in complexity as the traffic parameters at more and more traffic junctions are considered, and the complexity increases even further when traffic flow for one traffic junction is optimized in accordance with traffic flow from another traffic junction. By employing computer generated models, various embodiments described herein can analyze traffic parameters across one or more traffic junctions and optimize traffic flow in the one or more traffic junctions with greater speed and accuracy than that of a human, or a plurality of humans. For example, one or more models generated by the computer processing systems, computer-implemented methods, apparatus and/or computer program products employing hardware and/or software described herein can express traffic flow as a multivariate polynomial that can facilitate identification and optimization of a traffic junction's phase sequences.

One or more embodiments may be a system, a method, and/or a computer program product at any possible technical detail level of integration. The computer program product may include a computer readable storage medium (or media) having computer readable program instructions thereon for causing a processor to carry out aspects of the present invention. The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer-implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware based systems that perform the specified functions or acts or carry out combinations of special purpose hardware and computer instructions.

Figure 3:
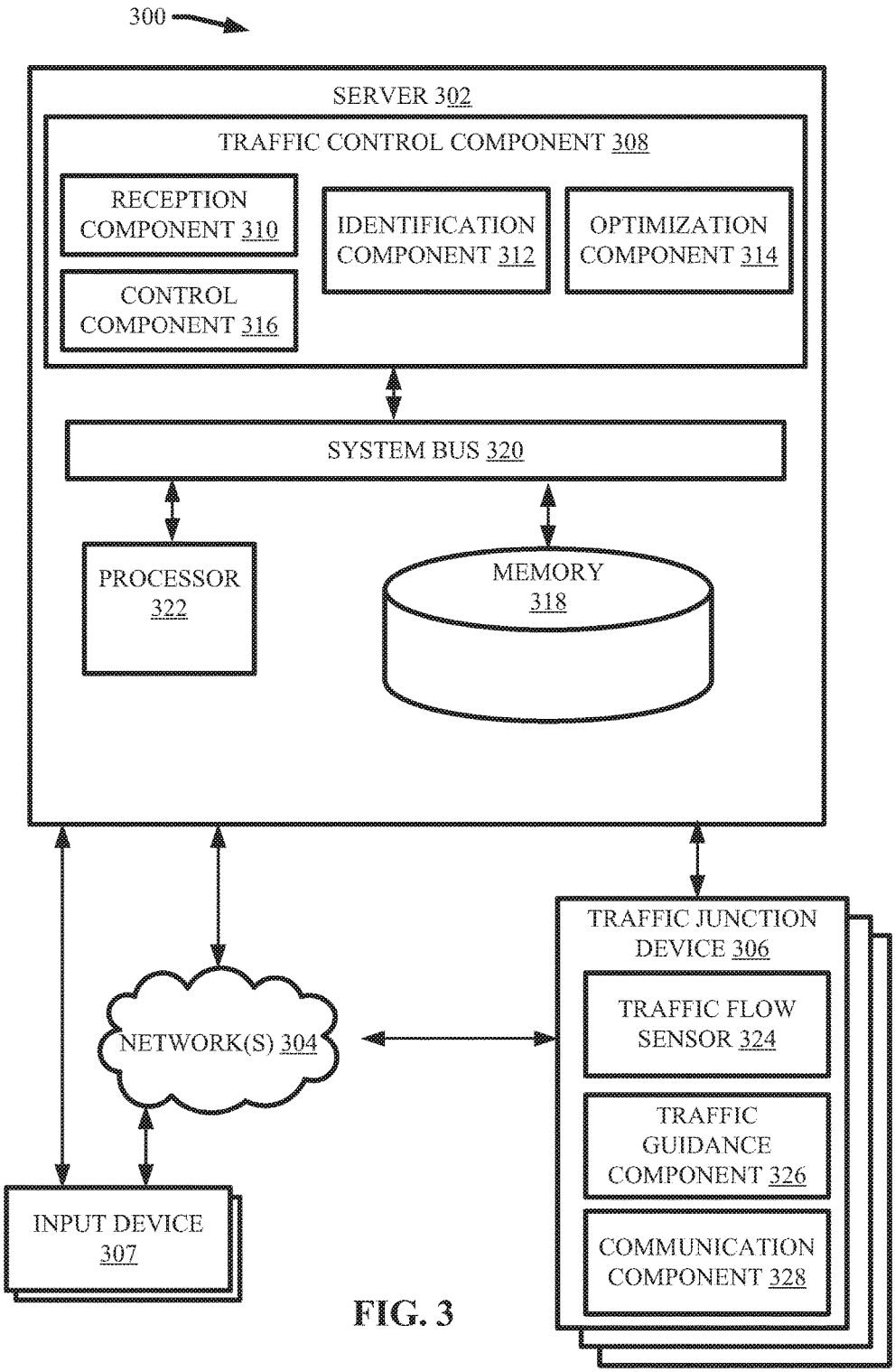
FIG. 3 illustrates a block diagram of an example, non-limiting system that identifies and optimizes phase sequences in one or more traffic junctions in accordance with one or more embodiments described herein.

FIG. 3 illustrates a block diagram of an example, non-limiting system 300 that identifies and optimizes phase sequences in one or more traffic junctions. Repetitive description of like elements employed in other embodiments described herein is omitted for sake of brevity. Aspects of systems (e.g., system 300 and the like), apparatuses or processes in various embodiments of the present invention can constitute one or more machine-executable components embodied within one or more machines, e.g., embodied in one or more computer readable mediums (or media) associated with one or more machines. Such components, when executed by the one or more machines, e.g., computers, computing devices, virtual machines, etc. can cause the machines to perform the operations described.

As shown in FIG. 3, the system 300 can comprise one or more servers 302, one or more networks 304, one or more traffic junction devices 306, and/or one or more input devices 307. The server 302 can comprise traffic control component 308. In some embodiments, the traffic control component 308 can further comprise reception component 310, identification component 312, optimization component 314, and/or control component 316. Also, the server 302 can comprise or otherwise be associated with at least one memory 318. The server 302 can further comprise a system bus 320 that can couple to various components such as, but not limited to, the traffic control component 308 and associated components, memory 318 and/or a processor 322. While a server 302 is illustrated in FIG. 3, in other embodiments, multiple devices of various types can be associated with or comprise the features shown in FIG. 3. Further, the server 302 can communicate with the cloud environment depicted in FIGS. 1 and 2 via the one or more networks 304.

The one or more networks 304 can comprise wired and wireless networks, including, but not limited to, a cellular network, a wide area network (WAN) (e.g., the Internet) or a local area network (LAN). For example, the server 302 can communicate with the one or more traffic junction devices 306 (and vice versa) using virtually any desired wired or wireless technology including for example, but not limited to: cellular, WAN, wireless fidelity (Wi-Fi), Wi-Max, WLAN, Bluetooth technology, a combination thereof, and/or the like. Further, although in the embodiment shown the traffic control component 308 can be provided on the one or more servers 302, it should be appreciated that the architecture of system 300 is not so limited. For example, the traffic control component 308, or one or more components of the traffic control component 308, can be located at another computer device, such as another server device, a client device, etc.

In some embodiments, the one or more traffic junction devices 306 can comprise one or more traffic flow sensors 324, traffic guidance component 326, and/or a communication component 328. The one or more traffic flow sensors 324 can identify traffic arriving and/or departing a respective traffic junction. In some embodiments, the one or more traffic flow sensors 324 can also determine a time at which identified traffic arrives and/or departs from a traffic junction. Further the one or more traffic flow sensors 324 can determine a first direction from which identified traffic arrives to a traffic junction and a second direction from which identified traffic departs from a traffic junction. Moreover, the one or more traffic flow sensors 324 can determine the type of traffic that arrives and/or departs a traffic junction. Example types of traffic include, but are not limited to: pedestrians, cars, emergency vehicles, trucks, semi-trucks, buses, trains, trams, trolleys, and/or boats.

The one or more traffic flow sensors 324 can comprise in-route sensors and over-route sensors. In-route sensors can be sensors embedded into the surface of a traffic route, embedded into a foundation of the traffic route, and/or attached to the traffic route. Example in-route sensors can include, but are not limited to: inductive-loop detectors, magnetometers, tape switches, turboelectric devices, seismic devices, inertia-switch devices, and pressure sensitive devices. Over-route sensors can be sensors located above a traffic route and/or alongside a traffic route (e.g., offset from the traffic route). Example over-route sensors can include, but are not limited to: video image processors (e.g., cameras), microwave radar devices, ultrasonic devices, passive infrared devices, laser radar devices, acoustic devices, GPS systems, and/or satellite systems (e.g., satellite imaging).

The one or more traffic flow sensors 324 can collect and/or determine data regarding traffic parameters at a traffic junction such as: types of traffic at the traffic junction, amount of traffic at the traffic junction, when each type of traffic at the traffic junction arrives and departs the traffic junction, and/or the route traveled through the traffic junction by each type of traffic identified at the traffic junction. Further, the one or more traffic flow sensors 324 can collect and/or determine the data over a defined cycle (e.g., starting from an action that permits traffic flow through an intersection and ending from an action that prohibits traffic flow) and/or a predetermined period of time (e.g., a period of time ranging from greater than or equal to one second to less than or equal to sixty seconds).

The traffic guidance component 326 can comprise one or more guidance signals that can identify when and/or how traffic is permitted to traverse a traffic route at a traffic junction. The guidance signals can be conveyed to traffic visually, audibly, and/or electronically. The flow of traffic at a traffic junction can be controlled via operation of one or more traffic guidance components 326. Example traffic guidance components 326 can include, but are not limited to: traffic lights (e.g., devices that can display shapes and/or colors), and/or crosswalk signs (e.g., devices that can display shapes and/or colors and generate an audible noise).

The communication component 328 can send the data collected and/or determined by the traffic flow sensor 324 and the status of one or more traffic guidance components 326 to one or more servers 302. The communication component 328 can be operably coupled to the server 302, and/or the communication component 328 can communicate with the server 302 via one or more networks 304. In an embodiment, the communication component 328 can communicate with the server 302 via a cloud environment such as the environment described herein with reference to FIGS. 1-2. The communication component 328 can be operably coupled to the traffic flow sensor 324, and/or the communication component 328 can communicate with the traffic flow sensor 324 via one or more networks 304. In an embodiment, the communication component 328 can communicate with the traffic flow sensor 324 via a cloud environment such as the environment described herein with reference to FIGS. 1-2. The communication component 328 can also be operably coupled to the traffic guidance component 326, and/or the communication component 328 can communicate with the traffic guidance component 326 via one or more networks 304. In an embodiment, the communication component 328 can communicate with the traffic guidance component 326 via a cloud environment such as the environment described herein with reference to FIGS. 1-2.

The one or more input devices 307 can be a computer device and/or means to enter data into a computer device. Example input devices 307 include, but are not limited to: a personal computer, a keyboard, a mouse, a computer tablet (e.g., a tablet comprising a processor and operating system), a smart-phone, and/or a website. The input device 307 can be operably coupled to the server 302, and/or the input device 307 can communicate with the server 302 via one or more networks 304. An entity can provide one or more servers 302 with traffic parameters for a traffic junction via the input device 307. For example, a pedestrian at a traffic junction can identify a traffic parameter (e.g., traffic at the traffic junction is at a stand-still) and/or a condition (e.g., an event is occurring near a traffic junction, and/or a traffic accident has occurred near a traffic junction) and send the traffic parameter to one or more servers 302 via an input device 307 (e.g., a smart-phone).

The reception component 310 can receive data collected and/or determined by the traffic flow sensor 324, data regarding the status of the traffic guidance component 326 (e.g., current and/or past phase sequences of a respective traffic junction), and/or traffic parameters and/or conditions sent via an input device 307. The reception component 310 can be operably coupled to the server 302, and/or the reception component 310 can communicate with the server 302 via one or more networks 304. The reception component 310 can be operably coupled to the communication component 328, and/or the reception component 310 can communicate with the communication component 328 via one or more networks 304. Also, the reception component 310 can be operably coupled to the input device 307, and/or the reception component 310 can communicate with the input device 307 via one or more networks 304.

The identification component 312 can generate one or more piece-wise sinusoidal representations based on the information received by the reception component 310. The identification component 312 can determine traffic flow at one or more traffic junctions associated with a traffic junction device 306, and generate one or more sinusoid signals.

Figure 4:
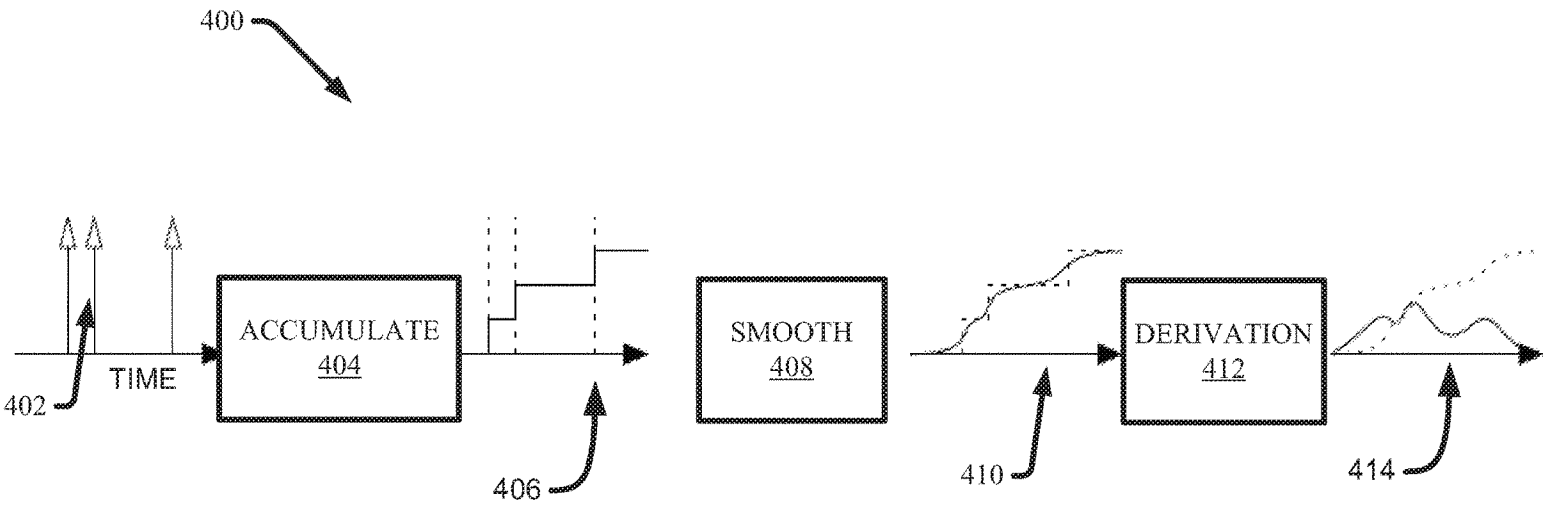
FIG. 4 illustrates a diagram of an example, non-limiting process that graphically expresses derivation of traffic arrival rates at a traffic junction in accordance with one or more embodiments described herein.

FIG. 4 illustrates a block diagram of an exemplary, non-limiting process that can be performed by the identification component 312 to generate one or more sinusoid signals. Repetitive description of like elements employed in other embodiments described herein is omitted for sake of brevity. In one or more embodiments, the identification component 312 can utilize low-pass filtering 400 to generate one or more sinusoid signals based on information received by the reception component 310.

Information received by the reception component 310 can be expressed as one or more Dirac signals 402 (presented as vertical arrows in FIG. 4) over a period of time (e.g., over a period of 1 to 60 seconds). In some embodiments, the Dirac signals 402 can correspond to events collected and/or determined by the traffic flow sensor 324. For example, in some embodiments, a Dirac signal 402 can indicate the arrival and/or departure of traffic (e.g., a car) at a traffic junction. The identification component 312 can accumulate the Dirac signals at 404 to generate a staircase projection 406. Further the staircase projection 406 can be smoothed at 408 into a differentiable function 410, and a derivation at 412 can generate a derivative 414 that can represent the instantaneous arrival rate of traffic at the traffic junction.

The identification component 312 can utilize Equation 1 and Equation 2, presented below, to generate the derivative 414.

$$N(t_1,t_2)=\int_{t_2}^{t_1}\lambda(t)dt \tag{1}$$

$$N(t_1,t_2)=\pi_{i:t_1\le T_i\le t_2}1=\int_{t_1}^{t_2}\Sigma\delta(t-T_i)dt \tag{2}$$

In Equations 1 and 2, $N(t_1,t_2)$ can denote the number of events (e.g., Dirac signals 402) during a time interval $[t_1,t_2]$, $T_i$ can denote event times (e.g., when traffic arrives at a traffic junction), and $\lambda(t)$ can denote a continuous event rate.

The identification component 312 can determine an event rate by aggregation of the Dirac signals 402 and subsequent differentiation. The smoothing at 408 can be performed to the staircase projection 406, or alternatively, the smoothing at 408 can be interpolation by a monotonic piecewise cubic spline.

In another embodiment, the identification component 312 can utilize a Poisson model to generate one or more sinusoidal representations. The identification component 312 can assume that events at a traffic junction (e.g., arrival of traffic) are a non-homogenous Poisson process (NHPP) and utilize Equation 3 and Equation 4 below. In other words, through Equations 3-4, the identification component 312 can utilize NHPP to determine the instantaneous event rate (e.g., arrival rate of traffic at a traffic junction) for a time period.

$$prob(N(a,b)=n)=\frac{\left(\int_a^b\lambda(t)dt\right)^n}{n!}e^{-\int_a^b\lambda(t)dt} \tag{3}$$

$$h(t;\Theta)=\sum_{i=0}^{m}\alpha_i t^i+\sum_{k=1}^{p}\gamma\sin(\omega_k t+\phi_k) \tag{4}$$

where $$\Theta=[\alpha_0,\alpha_1,\ldots,\alpha_m,\gamma_1,\ldots,\gamma_p,\phi_1,\ldots,\phi_p,\omega_1,\ldots,\omega_p$$

In some embodiments, m can represent a degree of a polynomial function representing a general trend of the events over time, p can denote periodic components and represent trigonometric functions associated with cyclic effects, $\{\alpha_1,\ldots,\alpha_m\}$ can represent a parameter vector, $\{\gamma_1,\ldots,\gamma_p\}$ can represent amplitudes of the Dirac signals 402, $\{\phi_1,\ldots,\phi_p\}$ can represent phases, and $\{\omega_1,\ldots,\omega_p\}$ can represent frequencies of the Dirac signals 402. Thus, a likelihood of a specific $\theta$ given a sequence of event times can be found and a standard maximum likelihood estimation can yield an estimate for $\lambda$. In another embodiment, the identification component 312 can utilize finite-rate-of-innovation (FRI) methods to generate one or more sinusoid representations.

The identification component 312 can generate one or more sinusoid signals for each type of traffic identified by the traffic flow sensor 324. Further the identification component 312 can concatenate multiple sinusoid signals to generate the piece-wise sinusoidal representation. The multivariate polynomial can be based on information received by the reception component 310. For example, the piece-wise sinusoidal representation can be based on, but not limited to: the amount of traffic identified by a traffic flow sensor 324; the time traffic arrives and/or departs from traffic junction; and the types of traffic at a traffic junction.

Figure 5:
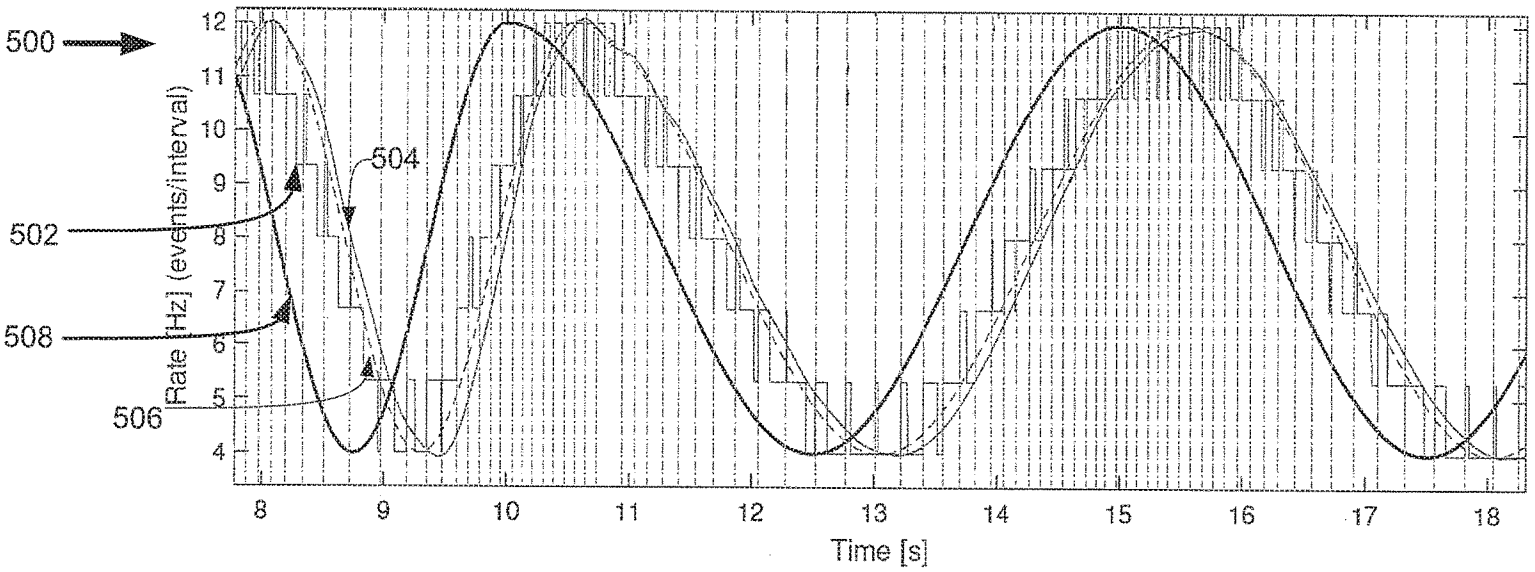
FIG. 5 illustrates a diagram of an example, non-limiting sinusoidal signal that can be generated based on at least measurement of events at a traffic junction in accordance with one or more embodiments.

FIG. 5 illustrates an exemplary, non-limiting graph 500 comprising a piece-wise sinusoidal representation that can be generated by the identification component 312. Repetitive description of like elements employed in other embodiments described herein is omitted for sake of brevity. Graph 500 can be generated by the identification component 312 via the low-pass filtering 400 depicted in FIG. 4. The vertical lines can indicate the occurrence of an event, such as the passing of traffic at a traffic junction and/or a traffic arrival at a traffic junction. A first line 502 can represent a rate estimation of the event (e.g., the traffic arrival) by averaging the frequency of the event over a fixed length window (e.g., a defined period of time, such as 0.75 seconds, and/or a phase sequence). A second line 504 can represent low-pass filtering of Dirac signals 402, wherein a third line 506 can denote low-pass filtering a true arrival rate 508.

Referring again to FIG. 3, in some embodiments, the optimization component 314 can optimize traffic flow at one or more traffic junctions based on a layout of the traffic junctions subject to optimization, including a sequence of phases for each traffic junction, and/or one or more multivariate polynomials generated by the optimization component 314 based on based on a priority scheme that provides weights for different types of traffic. In some embodiments, the optimization component 314 can optimize traffic flow based further on network specific features such as turn ratios.

A sequence of phases at a traffic junction can comprise a series of phases, wherein each phase can represent a respective configuration of the traffic guidance component 326 associated with the subject traffic junction. The traffic guidance component 326 can have multiple configurations, wherein each configuration (or, in some embodiments, one or more of the configurations) permits a different traffic route to be traveled by traffic at the traffic junction. Thus, a traffic junction's phase sequence can comprise a first period in which a traffic route, which traverses the traffic junction, is permitted to be traveled by one or more identified traffic and a second period in which the traffic route is prohibited to be traveled by one or more identified traffic.

For example, a first phase at a traffic junction can comprise a period in which the traffic guidance component 326 permits traffic to cross the traffic junction in an east to west direction. Also, a second phase at the traffic junction can comprise a second period in which the traffic guidance component 326 prohibits traffic to cross the traffic junction in the east to west direction. Further, a phase sequence for the traffic junction can comprise the first phase and the second phase. In other words, a traffic junction's phase sequence can indicate the time and/or order in which traffic routes traversing the traffic junction are permitted and/or prohibited by the traffic guidance component 326.

The phase sequence can comprise phases that have occurred over a defined time and/or a cycle of phases. For example, a phase sequence can comprise one or more configurations of a traffic guidance component 326 that occurred during a period of time (e.g., the period of time can range from equal to or greater than 1 minute to less than or equal to 1 hour). In another example, a phase sequence can comprise one or more configurations of a traffic guidance component 326 that occurred during a cycle, wherein the cycle can be defined as a certain number of phases (e.g., a number of phases that can define a cycle can be equal to or greater than 2 and less than or equal to 20).

A layout of a traffic junction can comprise the total possible configurations of the traffic guidance component 326 for the traffic junction. In various embodiments, a layout of a traffic junction can include, but is not limited to: the number of possible traffic routes at the traffic junction, the direction of the possible traffic routes at the traffic junction, and the traffic guidance component 326 capacity (e.g., which traffic routes the traffic guidance component 326 is capable of controlling). The layout and phase sequence of a traffic junction can be provided to the optimization component 314 by the traffic junction device 306 (e.g., the traffic guidance component 326 and/or the communication component 328) via the one or more networks 304 and/or the reception component 310.

The optimization component 314 can be operably coupled to the identification component 312, and/or the optimization component 314 can communicate with the identification component 312 via the one or more networks 304. Further, the optimization component 314 can be operably coupled to the memory 318, and/or the optimization component 314 can communicate with the memory 318 via the one or more networks 304. In one or more embodiments, the optimization component 314 can receive one or more multivariate polynomials generated by the identification component 312 directly from the identification component 312. In various embodiments, the identification component 312 can store one or more of the generated multivariate polynomials the memory 318, and the optimization component 314 can retrieve one or more of the stored multivariate polynomials from the memory 318.

In one or more embodiments, a priority scheme can be sent to the server 302 by an input device 307 either directly or via one or more networks 304 and provided to the optimization component 314 via the reception component 310. In various embodiments, one or more priority schemes can be stored in the memory 318, and the optimization component 314 can retrieve the one or more priority schemes from the memory 318. A priority scheme can prioritize traffic flow based on a type of traffic, a time of day, a queue length of traffic at a traffic junction, and/or a special event (e.g., an event that will alter normal traffic conditions, such as an event and/or a parade). For example, a priority scheme can indicate that one type of traffic (e.g., buses) identified at a traffic junction have a higher priority than another type of traffic (e.g., cars) at the traffic junction. The optimization component 314 can optimize traffic flow based on one or more types of traffic that are highly prioritized, as indicated by the priority scheme.

In various embodiments, the priority scheme can be represented as a polynomial function, and thereby be considered by the optimization component 314 as a polynomial objective. As used herein a "polynomial objective" can refer to a polynomial function that indicates a prioritization of one or more variables of traffic at a traffic junction. One or more variables of traffic at a traffic junction include, but are not limited to: one or more types of traffic, one or more queue lengths for respective traffic types, a number of operational traffic junctions subject to optimization by the optimization component 314, one or more events (e.g., an event or a parade), and/or the location of one or more parking lots.

Data that can be provided by the traffic guidance component 326, and/or derived from data provided by the traffic guidance component 326, and analyzed by the optimization component 314 can include, but is not limited to: a number of traffic junctions subject to optimization (e.g., two or more traffic junctions); a number of traffic routes that link the traffic junctions subject to optimization together; and/or a number of phases available at each traffic junction (e.g., one or more phase sequences).

Further, data that can be provided by the traffic flow sensor 324 in conjunction with the identification component 312 and analyzed by the optimization component 314 can include, but is not limited to: an amount of traffic in queue at a traffic junction and the direction of the traffic in queue (e.g., an indication of the length of a queue at a traffic junction and/or an indication of the direction to which the queue extends); an amount of traffic (e.g. number of vehicles) arriving at a traffic junction from a destination other than another traffic junction in the subject optimization; an amount of traffic (e.g., number of vehicles) at a traffic junction at a point in time, including traffic originating from another traffic junction subject to optimization and traffic not originating from another traffic junction subject to optimization; a ratio of traffic (e.g., number of vehicles) at a traffic junction that indicate a desire to go in a particular direction (e.g., traffic indicating a desire to travel straight, traffic indicating a desire to turn left, and/or traffic indicating a desire to turn right); and/or an amount of traffic (e.g. number of vehicles) departing a traffic junction via a traffic route that does not lead to another traffic junction subject to optimization.

The optimization component 314 can generate, based on the information provided, collected, and/or determined, one or more multi-variate polynomials. For example, the optimization component 314 can generate a multi-variate polynomial based: on one or more piece-wise sinusoidal representations generated by the identification component 312; one or more priority schemes; and/or information collected and/or derived from one or more traffic junction devices 306. The multi-variate polynomial can distinguish between one or more average queue lengths of one or more traffic types at one or more traffic junction s over one or more phase sequence. Also, the multi-variate polynomial can describe one or more time delays of traffic at one or more traffic junctions over a period of time (e.g., one or more phase sequences). The time delay can be relative to one or more time tables and/or one or more desired routes. A route can be desired because it is perceived to be the fastest route to a destination from a traffic junction. In one or more embodiments, the time table and/or the desired route can be stored in the memory 318 and retrieved by the optimization component 314 and/or can be sent to the server 302 via the input device 307.

Also, the optimization component 314 can generate, based on the information provided, collected, and/or determined, one or more control directives to be implemented by one or more traffic junction devices 306 in order to optimize traffic flow. The optimization component 314 can make various assumption in generating the one or more control directives. First, the optimization component 314 can assume that each traffic junction subject to optimization has a common cycle time and a common frequency of a phase sequence. Second, the optimization component 314 can assume that exogenous arrivals into a traffic network are piece-wise sinusoidal processes of the same frequency, wherein the traffic network comprises the traffic junctions subject to optimization and linked together by common traffic routes. In other words, the optimization component 314 can consider the traffic as a switched systems, where exogenous arrivals and departures to the traffic network can be periodic processes of the same frequency, but where after each switch the exogenous arrivals or departures can have distinct amplitudes and time changes across the sinusoidal signals.

The switch can represent a distinct change in traffic volumes at a subject traffic junction. The switch can be derived from historical data and/or current events (e.g., the occurrence of a traffic accident or a public event). For example, the switch can represent a change from a rush hour period (e.g., a period of time in which a traffic junction can experience a large amount of traffic due at least to individuals traveling to or from their respective workplaces at the same time) to a non-rush hour period (e.g., a period of time in which a traffic junction experiences a smaller amount of traffic as compared to the rush hour period). Thus, a switch at a traffic junction can mark a change in the average amount traffic arriving and serviced by the traffic junction.

Third, the optimization component 314 can assume that for each description of the exogenous arrivals and departures, there can exist a finite minimum duration, such that between two switches of the second assumption, there can be at least the minimum duration.

Fourth, the optimization component 314 can assume that the average of periodic exogenous arrival rates e(t) to a traffic network, wherein the traffic network comprises the traffic junctions subject to optimization and linked together by common traffic routes, can be a vector by Equation 5.

$$\bar{e} = \frac{1}{T}\int_0^T e(t)dt \in R^Q \tag{5}$$

In Equation 5, Q can be the number of traffic queues at a traffic junction and denote further the vector of service rates c(t) and the average service rate by Equation 6, wherein service rate can represent an amount of traffic passing through the traffic junction.

$$\bar{c} = \frac{1}{T}\int_0^T e(t)dt \in R^Q \tag{6}$$

Additionally, the optimization component 314 can assume that, on average for every queue, the service rate exceeds the total arrival rate by a value E, wherein ε>0, as represented by Equation 7.

$$\bar{c} > (I - R^T)^{-1}\bar{e} + \varepsilon 1 \tag{7}$$

In Equation 7, R can represent a matrix with an amount of traffic (e.g., number of vehicles) desiring to go a particular direction at a traffic junction. Fifth, the optimization component 314 can assume that each arriving traffic leaves the subject traffic network, wherein the traffic network comprises the traffic junctions subject to optimization and linked together by common traffic routes, after visiting a finite number of traffic junctions subject to optimization. Assumptions two through five can ensure that after each switch (e.g., from a morning rush-hour to a non-rush-hour), transients decay quickly and a stationary limit cycle (e.g., periodic queue lengths at each traffic junction subject to optimization) is followed for most of the interval between switches.

The optimization component 314 can generate a model that converges to a unique periodic orbit. Further the unique periodic orbit can exhibit the following characteristics: (i) after each switch, the model can stabilize to a unique periodic state trajectory with a period dependent on the choice of optimization (e.g., in accordance with a priority scheme); (ii) an average queue length in the periodic stat trajectory can be well-approximated by a product-form solution; and (iii) independently of the average queue length in the periodic state trajectory each queue is cleared at least once within the state trajectory. For any segment that makes up the multivariate polynomial, there exists a finite bound on the convergence, which assumption three assures that no switch occurs prior to the convergence. The optimization component 314 can then optimize one or more properties of the periodic orbit based on the multivariate polynomial. For example, the optimization component 314 can minimize the square of the average queue length at each traffic junction over the periodic orbit by minimizing a difference between the traffic arrival offset between traffic junctions.

Further the optimization component 314 can formulate one or more optimization objectives, per traffic type, in terms of one or more trigonometric functions of the phase offsets. Example optimization objectives can include, but are not limited to: an average amount of one or more traffic types in queue at a traffic junction over a period of time; an average amount of one or more traffic types in queue at a traffic junction over a phase sequence; an average amount of delay of one or more traffic types in queue at a traffic junction over a period of time; and an average amount of delay of one or more traffic types in queue at a traffic junction over a phase sequence. Further, the optimization component 314 can reformulate the trigonometric functions to polynomials.

For example, in various embodiments, the optimization component 314 can optimize traffic flow across a traffic network comprising N number of traffic junctions. Each traffic junction in the traffic network can be associated with a sequence of phases, and one traffic junction in the traffic network can serve as a reference. The identification component 312 can generate a (kN)-variate polynomial for each traffic type of k number of traffic types. The optimization component 314 can optimize the offset of a first phase of the sequence of phases at each traffic junction in the traffic network relative to the reference traffic junction with respect to the average of the (kN)-variate polynomial over time. Wherein the variables of the one or more polynomials can comprise parameters of each traffic type at each traffic junction in the traffic network at a given time. Moreover, the optimization component 314 can generate control directives that when actualized by one or more traffic junction devices 306 will result in realization of the optimizations determined by the optimization component 314. In one or more embodiments, the optimization component 314 can also consider varying turn ratios as a bi-level optimization problem, wherein the turn ratios are at the lower level of the optimization problem and the phase offsets are at the upper level of the optimization problem.

In one or more embodiments, the optimization component 314 can generate control directives that optimize traffic flow by varying offsets between traffic junctions. For example, the optimization component 314 can vary an offset between phase sequences between traffic junctions. Further, the optimization component can vary offsets based on one or more traffic types to prioritize traffic flow of one or more traffic types (e.g., two traffic types) over one or more other traffic types (e.g., a third traffic type). In other words, the optimization component 314 can generate the multi-variate polynomial optimization problem and minimize polynomial objectives (e.g., in accordance with a priority scheme) where the variables are the offsets (or other parameters). The optimization component 314 can then generate new offsets between phase sequences of one or more traffic junctions as control directives to optimize a traffic flow amongst the traffic junctions.

In various embodiments, the optimization component 314 can also vary the matrix R in addition to, or alternatively to, the offset. For example, the optimization component 314 can vary the R matrix in a bi-level optimization fashion, wherein the server 302 is considered one player optimizing the polynomial objective and one or more traffic drivers at one or more traffic junctions subject to optimization can be considered to be one or more additional players that can make route decisions reflected in the matrix R. The one or more traffic drivers can make decisions so as to choice a route that minimizes their travel time. Thus, the optimization component 314 can consider turn ratios and/or traffic driver objectives (e.g., fastest route objectives) in the optimization function via at least variance in the R matrix.

The control component 316 can send the control directives generated by the optimization component 314 to the one or more devices. For example, the control component 316 can send the control directives generated by the optimization component 314 to the one or more traffic junction devices 306. As the traffic junction devices 306 implement the control directives, traffic flow amongst the one or more traffic junctions associated with the one or more traffic junction devices 306 can be optimized in accordance with the optimization objectives considered by the optimization component 314. The control component 316 can be operably coupled to the optimization component 314, and/or the control component 316 can communicate with the optimization component 314 via the one or more networks 304. Further, the control component 316 can be operably coupled to the one or more traffic junction devices 306, and/or the control component 316 can communicate with the one or more traffic junction devices 306 via the one or more networks 304.

Figure 6:
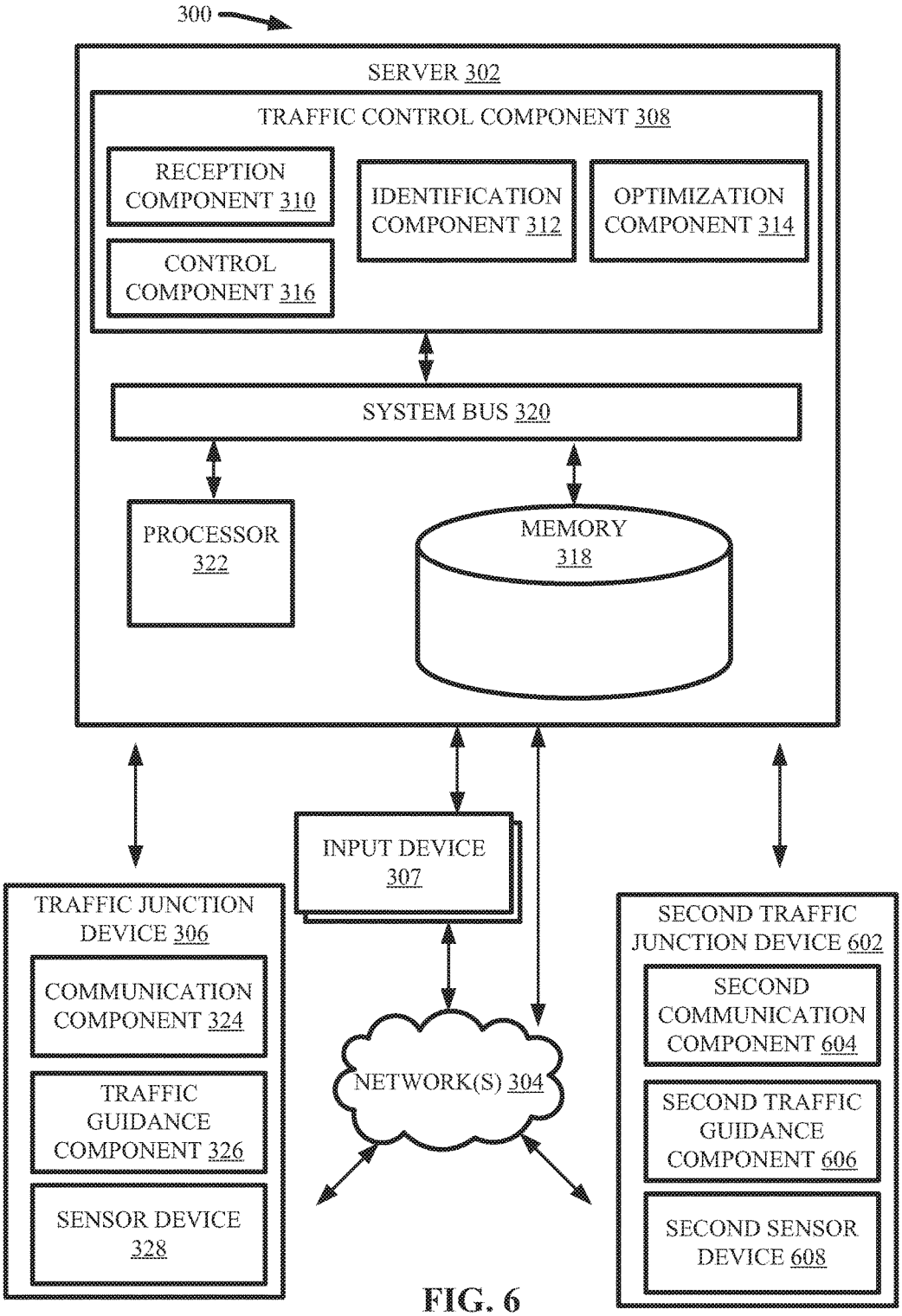
FIG. 6 illustrates a block diagram of an example, non-limiting system that identifies and optimizes phase sequences between at least two traffic junctions in accordance with one or more embodiments described herein.

FIG. 6 illustrates a non-limiting example of the system 300 that comprises at least two traffic junction devices (e.g., traffic junction device 306 and second traffic junction device 602). Repetitive description of like elements employed in other embodiments described herein is omitted for sake of brevity.

The second traffic junction device 602 can comprise: one or more second traffic flow sensors 604, one or more second traffic guidance components 606, and one or more second communication components 608. The second traffic junction device 602, and one or more of its associate features, can function in the same manner as described above with regard to the traffic junction device 306. The server 302 can receive information from both the traffic junction device 306 and the second traffic junction device 602.

Further, the identification component 312 can generate one or more multivariate polynomials based on information collected and/or derived by both the traffic junction device 306 and the second traffic junction device 602. For example, the identification component 312 can generate a piece-wise multivariate polynomial as a concatenation of a plurality of sinusoid signals, wherein one or more sinusoid signals of the plurality of sinusoid signals are based on information collected by the traffic junction device 306 and one or more sinusoid signals of the plurality of sinusoid signals are based on information collected by the second traffic junction device 602. Further, the optimization component 314 can generate control directives regarding both the traffic junction device 306 and the second traffic junction 602, and the control component 316 can send the generated control directives to the respective traffic junction device regarded by the respective control directive. Moreover, while FIG. 6 illustrates only one second traffic junction device 602, the system 300 comprising multiple second traffic junction devices 602 is also envisaged.

Figure 7:
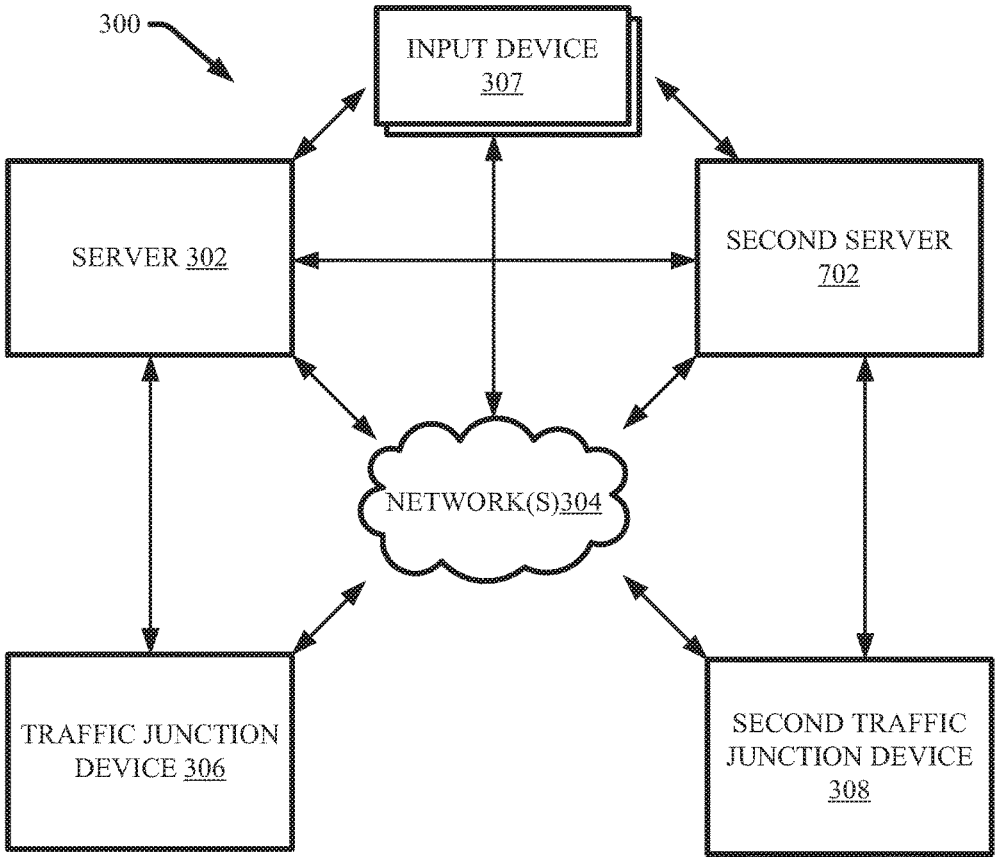
FIG. 7 illustrates a block diagram of an example, non-limiting system that identifies and optimizes phase sequences in one or more traffic junctions in accordance with one or more embodiments described herein.

FIG. 7 illustrates a non-limiting example of the system 300 that comprises multiple servers (e.g., server 302 and second server 702) in addition to multiple traffic junction devices (e.g., traffic junction device 306 and second traffic junction device 602). Repetitive description of like elements employed in other embodiments described herein is omitted for sake of brevity. The second server 702 can comprise similar components as those described above with regard to server 302 and perform similar functions as those described above with regard to server 302. Server 302 and second server 702 can be operably coupled, and/or server 302 and second server 702 can communicate via one or more networks 304. In various embodiments, server 302 can be responsible for generating multivariate polynomials, optimizing traffic flow based on optimization objectives, and generating control directives with regard to a traffic junction (e.g., traffic junction device 306); whereas the second server 702 can be responsible for generating multivariate polynomials, optimizing traffic flow based on optimization objectives, and generating control directives with regard to another traffic junction (e.g., second traffic junction device 602).

Server 302 and second server 702 can communicate received information (e.g., data regarding the respective server's respective traffic junction) and/or derived information (e.g., generated multivariate polynomials, and/or generated control directives). Since the system 300 can comprise multiple servers in communication with each other (e.g., via a cloud environment), the system 300 can be de-centralized and less susceptible to a single-point-of-failure scenario. Moreover, while FIG. 7 illustrates only one second server 702, the system 300 comprising multiple second server 702 is also envisaged.

Figure 8:
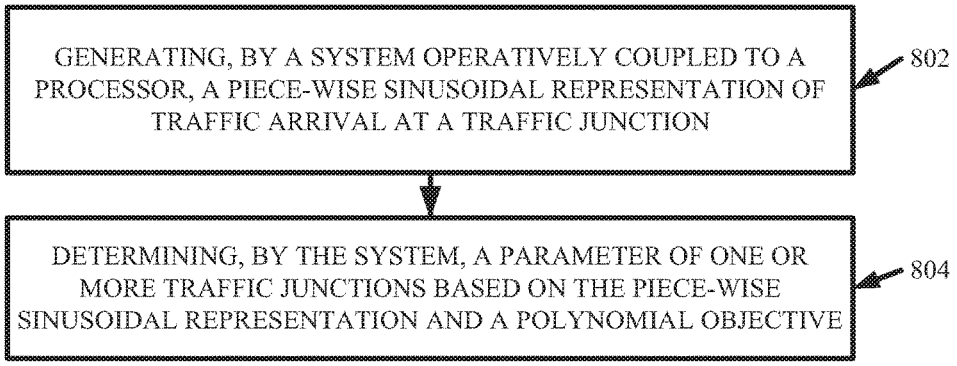
FIG. 8 illustrates a flow chart of an example, non-limiting computer-implemented method that facilitates identification and optimization phase sequences in one or more traffic junctions in accordance with one or more embodiments described herein.

FIG. 8 illustrates a flow diagram of an example, non-limiting computer-implemented method 800 that can facilitate identifying and optimizing traffic flow amongst one or more traffic junctions in accordance with one or more embodiments described herein. Repetitive description of like elements employed in other embodiments described herein is omitted for sake of brevity. At 802, the method 800 can comprise generating, by a system 300 (e.g., via identification component 312) operatively coupled to a processor 322, a piece-wise sinusoidal representation (e.g., graph 500) of traffic arrival at a traffic junction. Also, at 804 the method 800 can comprise determining, by the system 300 (e.g., via optimization component 314), a parameter of one or more traffic junctions based on the piece-wise sinusoidal representation (e.g., graph 500) and a polynomial objective (e.g., a priority scheme).

Figure 9:
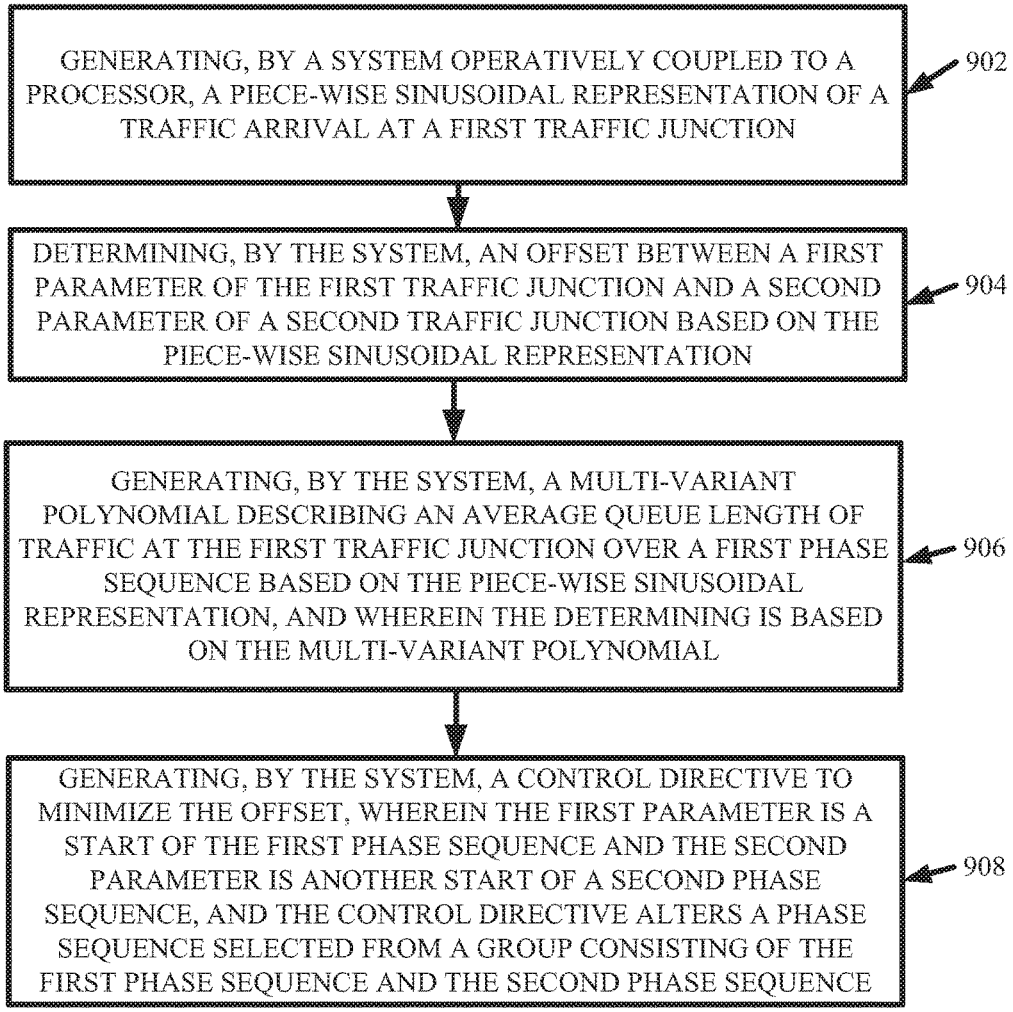
FIG. 9 illustrates another flow chart of an example, non-limiting computer-implemented method that facilitates identification and optimization phase sequences in one or more traffic junctions in accordance with one or more embodiments described herein.

FIG. 9 illustrates a flow diagram of an example, non-limiting computer-implemented method 900 that can facilitate identifying and optimizing traffic flow amongst one or more traffic junctions in accordance with one or more embodiments described herein. Repetitive description of like elements employed in other embodiments described herein is omitted for sake of brevity. At 902, the method 900 can comprise generating, by a system 300 (e.g., via identification component 312) operatively coupled to a processor 322, a piece-wise sinusoidal representation (e.g., graph 500) of a traffic arrival at a first traffic junction. Also, at 904 the method 900 can comprise determining, by the system 300 (e.g., via optimization component 314), an offset between a first parameter of the first traffic junction and a second parameter of a second traffic junction based on the piece-wise sinusoidal representation (e.g., graph 500). The first parameter can be the start of a first phase sequence and the second parameter can be the start of a second phase sequence. Further, the first traffic junction can comprise a traffic route and the first phase sequence can comprise a first period in which the traffic route is prohibited to traffic and a second period in which the traffic route is permitted to traffic.

At 906 the method 900 can comprise generating, by the system 300 (e.g., via optimization component 314), a multi-variate polynomial describing an average queue length of traffic at the first traffic junction over a first phase sequence based on the piece-wise sinusoidal representation (e.g., graph 500), and wherein the determining is based on the multi-variate polynomial. The traffic described by the multi-variate polynomial can be of a first traffic type including, but not limited to: a car (e.g., a car and/or a taxi), a bus, a bicycle, an emergency vehicle, a motorcycle, a truck (e.g., a semi-truck), a tram, a trolley, and/or a train. Also, the multi-variate polynomial can distinguish between a first average queue length of a first traffic type at the first traffic junction over the first phase sequence and a second average queue length of a second traffic type at the first traffic junction of the first phase sequence. Further, the multi-variate polynomial can further describe a time delay (e.g., relative to a time table and/or fastest route, wherein the time table and/or fastest route can be stored in the memory 318 or provided by the input device 307) of the traffic at the first traffic junction over the first phase sequence.

At 908, the method 900 can comprise generating, by the system 300 (e.g., optimization component 314) a control directive to minimize the offset, wherein the first parameter is a start of the first phase sequence and the second parameter is another start of a second phase sequence. The control directive can alter a phase sequence selected from a group consisting of the first phase sequence and the second phase sequence. The control directives can control a traffic guidance device at a traffic junction based on a determined offset by the system 300 (e.g., optimization component 314).

Figure 10:
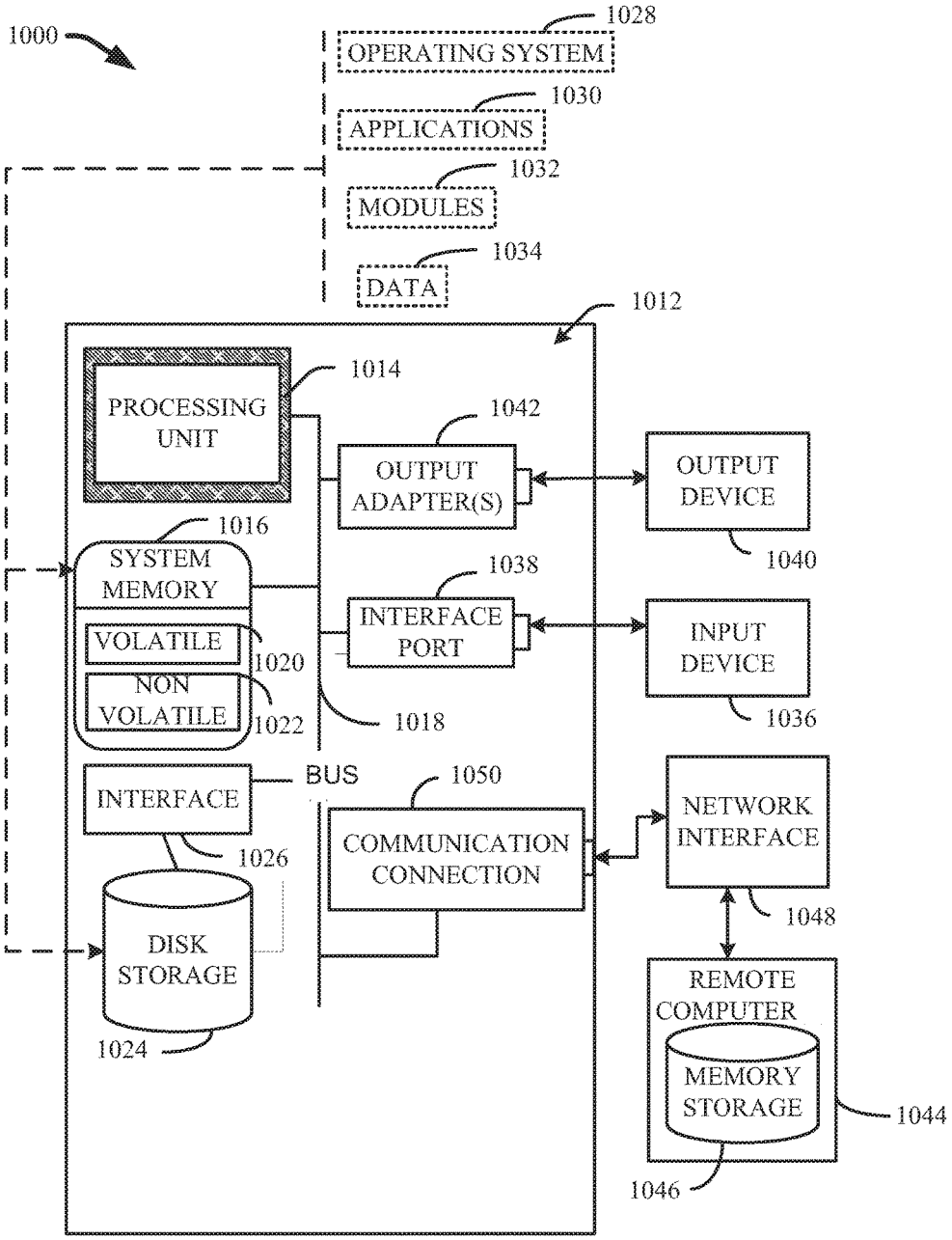
FIG. 10 illustrates a block diagram of an example, non-limiting operating environment in which one or more embodiments described herein can be facilitated.

In order to provide a context for the various aspects of the disclosed subject matter, FIG. 10 as well as the following discussion are intended to provide a general description of a suitable environment in which the various aspects of the disclosed subject matter can be implemented. FIG. 10 illustrates a block diagram of an example, non-limiting operating environment in which one or more embodiments described herein can be facilitated. Repetitive description of like elements employed in other embodiments described herein is omitted for sake of brevity. With reference to FIG. 10, a suitable operating environment 1000 for implementing various aspects of this disclosure can include a computer 1012. The computer 1012 can also include a processing unit 1014, a system memory 1016, and a system bus 1018. The system bus 1018 can operably couple system components including, but not limited to, the system memory 1016 to the processing unit 1014. The processing unit 1014 can be any of various available processors. Dual microprocessors and other multiprocessor architectures also can be employed as the processing unit 1014. The system bus 1018 can be any of several types of bus structures including the memory bus or memory controller, a peripheral bus or external bus, and/or a local bus using any variety of available bus architectures including, but not limited to, Industrial Standard Architecture (ISA), Micro-Channel Architecture (MSA), Extended ISA (EISA), Intelligent Drive Electronics (IDE), VESA Local Bus (VLB), Peripheral Component Interconnect (PCI), Card Bus, Universal Serial Bus (USB), Advanced Graphics Port (AGP), Firewire, and Small Computer Systems Interface (SCSI). The system memory 1016 can also include volatile memory 1020 and nonvolatile memory 1022. The basic input/output system (BIOS), containing the basic routines to transfer information between elements within the computer 1012, such as during start-up, can be stored in nonvolatile memory 1022. By way of illustration, and not limitation, nonvolatile memory 1022 can include read only memory (ROM), programmable ROM (PROM), electrically programmable ROM (EPROM), electrically erasable programmable ROM (EEPROM), flash memory, or nonvolatile random access memory (RAM) (e.g., ferroelectric RAM (FeRAM). Volatile memory 1020 can also include random access memory (RAM), which acts as external cache memory. By way of illustration and not limitation, RAM is available in many forms such as static RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM.

Computer 1012 can also include removable/non-removable, volatile/non-volatile computer storage media. FIG. 10 illustrates, for example, a disk storage 1024. Disk storage 1024 can also include, but is not limited to, devices like a magnetic disk drive, floppy disk drive, tape drive, Jaz drive, Zip drive, LS-100 drive, flash memory card, or memory stick. The disk storage 1024 also can include storage media separately or in combination with other storage media including, but not limited to, an optical disk drive such as a compact disk ROM device (CD-ROM), CD recordable drive (CD-R Drive), CD rewritable drive (CD-RW Drive) or a digital versatile disk ROM drive (DVD-ROM). To facilitate connection of the disk storage 1024 to the system bus 1018, a removable or non-removable interface can be used, such as interface 1026. FIG. 10 also depicts software that can act as an intermediary between users and the basic computer resources described in the suitable operating environment 1000. Such software can also include, for example, an operating system 1028. Operating system 1028, which can be stored on disk storage 1024, acts to control and allocate resources of the computer 1012. System applications 1030 can take advantage of the management of resources by operating system 1028 through program modules 1032 and program data 1034, e.g., stored either in system memory 1016 or on disk storage 1024. It is to be appreciated that this disclosure can be implemented with various operating systems or combinations of operating systems. A user enters commands or information into the computer 1012 through one or more input devices 1036. Input devices 1036 can include, but are not limited to, a pointing device such as a mouse, trackball, stylus, touch pad, keyboard, microphone, joystick, game pad, satellite dish, scanner, TV tuner card, digital camera, digital video camera, web camera, and the like. These and other input devices can connect to the processing unit 1014 through the system bus 1018 via one or more interface ports 1038. The one or more Interface ports 1038 can include, for example, a serial port, a parallel port, a game port, and a universal serial bus (USB). One or more output devices 1040 can use some of the same type of ports as input device 1036. Thus, for example, a USB port can be used to provide input to computer 1012, and to output information from computer 1012 to an output device 1040. Output adapter 1042 can be provided to illustrate that there are some output devices 1040 like monitors, speakers, and printers, among other output devices 1040, which require special adapters. The output adapters 1042 can include, by way of illustration and not limitation, video and sound cards that provide a means of connection between the output device 1040 and the system bus 1018. It should be noted that other devices and/or systems of devices provide both input and output capabilities such as one or more remote computers 1044.

Computer 1012 can operate in a networked environment using logical connections to one or more remote computers, such as remote computer 1044. The remote computer 1044 can be a computer, a server, a router, a network PC, a workstation, a microprocessor based appliance, a peer device or other common network node and the like, and typically can also include many or all of the elements described relative to computer 1012. For purposes of brevity, only a memory storage device 1046 is illustrated with remote computer 1044. Remote computer 1044 can be logically connected to computer 1012 through a network interface 1048 and then physically connected via communication connection 1050. Further, operation can be distributed across multiple (local and remote) systems. Network interface 1048 can encompass wire and/or wireless communication networks such as local-area networks (LAN), wide-area networks (WAN), cellular networks, etc. LAN technologies include Fiber Distributed Data Interface (FDDI), Copper Distributed Data Interface (CDDI), Ethernet, Token Ring and the like. WAN technologies include, but are not limited to, point-to-point links, circuit switching networks like Integrated Services Digital Networks (ISDN) and variations thereon, packet switching networks, and Digital Subscriber Lines (DSL). One or more communication connections 1050 refers to the hardware/software employed to connect the network interface 1048 to the system bus 1018. While communication connection 1050 is shown for illustrative clarity inside computer 1012, it can also be external to computer 1012. The hardware/software for connection to the network interface 1048 can also include, for exemplary purposes only, internal and external technologies such as, modems including regular telephone grade modems, cable modems and DSL modems, ISDN adapters, and Ethernet cards.

Embodiments of the present invention can be a system, a method, an apparatus and/or a computer program product at any possible technical detail level of integration. The computer program product can include a computer readable storage medium (or media) having computer readable program instructions thereon for causing a processor to carry out aspects of the present invention. The computer readable storage medium can be a tangible device that can retain and store instructions for use by an instruction execution device. The computer readable storage medium can be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium can also include the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network can include copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device. Computer readable program instructions for carrying out operations of various aspects of the present invention can be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions can execute entirely on the user's computer, partly on the user's computer, as a stand-alone software package, partly on the user's computer and partly on a remote computer or entirely on the remote computer or server. In the latter scenario, the remote computer can be connected to the user's computer through any type of network, including a local area network (LAN) or a wide area network (WAN), or the connection can be made to an external computer (for example, through the Internet using an Internet Service Provider). In some embodiments, electronic circuitry including, for example, programmable logic circuitry, field-programmable gate arrays (FPGA), or programmable logic arrays (PLA) can execute the computer readable program instructions by utilizing state information of the computer readable program instructions to customize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions. These computer readable program instructions can be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions can also be stored in a computer readable storage medium that can direct a computer, a programmable data processing apparatus, and/or other devices to function in a particular manner, such that the computer readable storage medium having instructions stored therein includes an article of manufacture including instructions which implement aspects of the function/act specified in the flowchart and/or block diagram block or blocks. The computer readable program instructions can also be loaded onto a computer, other programmable data processing apparatus, or other device to cause a series of operational acts to be performed on the computer, other programmable apparatus or other device to produce a computer-implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams can represent a module, segment, or portion of instructions, which includes one or more executable instructions for implementing the specified logical function(s). In some alternative implementations, the functions noted in the blocks can occur out of the order noted in the Figures. For example, two blocks shown in succession can, in fact, be executed substantially concurrently, or the blocks can sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the subject matter has been described above in the general context of computer-executable instructions of a computer program product that runs on a computer and/or computers, those skilled in the art will recognize that this disclosure also can or can be implemented in combination with other program modules. Generally, program modules include routines, programs, components, data structures, etc. that perform particular tasks and/or implement particular abstract data types. Moreover, those skilled in the art will appreciate that the inventive computer-implemented methods can be practiced with other computer system configurations, including single-processor or multiprocessor computer systems, mini-computing devices, mainframe computers, as well as computers, hand-held computing devices (e.g., PDA, phone), microprocessor-based or programmable consumer or industrial electronics, and the like. The illustrated aspects can also be practiced in distributed computing environments where tasks are performed by remote processing devices that are linked through a communications network. However, some, if not all aspects of this disclosure can be practiced on stand-alone computers. In a distributed computing environment, program modules can be located in both local and remote memory storage devices.

As used in this application, the terms "component," "system," "platform," "interface," and the like, can refer to and/or can include a computer-related entity or an entity related to an operational machine with one or more specific functionalities. The entities disclosed herein can be either hardware, a combination of hardware and software, software, or software in execution. For example, a component can be, but is not limited to being, a process running on a processor, a processor, an object, an executable, a thread of execution, a program, and/or a computer. By way of illustration, both an application running on a server and the server can be a component. One or more components can reside within a process and/or thread of execution and a component can be localized on one computer and/or distributed between two or more computers. In another example, respective components can execute from various computer readable media having various data structures stored thereon. The components can communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor. In such a case, the processor can be internal or external to the apparatus and can execute at least a part of the software or firmware application. As yet another example, a component can be an apparatus that provides specific functionality through electronic components without mechanical parts, wherein the electronic components can include a processor or other means to execute software or firmware that confers at least in part the functionality of the electronic components. In an aspect, a component can emulate an electronic component via a virtual machine, e.g., within a cloud computing system.

In addition, the term "or" is intended to mean an inclusive "or" rather than an exclusive "or." That is, unless specified otherwise, or clear from context, "X employs A or B" is intended to mean any of the natural inclusive permutations.

That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. As used herein, the terms "example" and/or "exemplary" are utilized to mean serving as an example, instance, or illustration. For the avoidance of doubt, the subject matter disclosed herein is not limited by such examples. In addition, any aspect or design described herein as an "example" and/or "exemplary" is not necessarily to be construed as preferred or advantageous over other aspects or designs, nor is it meant to preclude equivalent exemplary structures and techniques known to those of ordinary skill in the art.

As it is employed in the subject specification, the term "processor" can refer to substantially any computing processing unit or device including, but not limited to, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components, or any combination thereof designed to perform the functions described herein. Further, processors can exploit nano-scale architectures such as, but not limited to, molecular and quantum-dot based transistors, switches and gates, in order to optimize space usage or enhance performance of user equipment. A processor can also be implemented as a combination of computing processing units. In this disclosure, terms such as "store," "storage," "data store," "data storage," "database," and substantially any other information storage component relevant to operation and functionality of a component are utilized to refer to "memory components," entities embodied in a "memory," or components including a memory. It is to be appreciated that memory and/or memory components described herein can be either volatile memory or nonvolatile memory, or can include both volatile and nonvolatile memory. By way of illustration, and not limitation, nonvolatile memory can include read only memory (ROM), programmable ROM (PROM), electrically programmable ROM (EPROM), electrically erasable ROM (EEPROM), flash memory, or nonvolatile random access memory (RAM) (e.g., ferroelectric RAM (FeRAM). Volatile memory can include RAM, which can act as external cache memory, for example. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), direct Rambus RAM (DRRAM), direct Rambus dynamic RAM (DRDRAM), and Rambus dynamic RAM (RDRAM). Additionally, the disclosed memory components of systems or computer-implemented methods herein are intended to include, without being limited to including, these and any other suitable types of memory.

What has been described above include mere examples of systems, computer program products and computer-implemented methods. It is, of course, not possible to describe every conceivable combination of components, products and/or computer-implemented methods for purposes of describing this disclosure, but one of ordinary skill in the art can recognize that many further combinations and permutations of this disclosure are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim. The descriptions of the various embodiments have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A system, comprising:

a memory that stores computer executable components;

a processor, operably coupled to the memory, and that executes the computer executable components stored in the memory, wherein the computer executable components comprise:

an identification component that generates a piece-wise sinusoidal representation of traffic arriving at a first traffic junction;

an optimization component that determines an offset between a start of a first phase sequence of the first traffic junction and a start of a second phase sequence of a second traffic junction based on the piece-wise sinusoidal representation; and generating, by the system, a multi-variate polynomial describing an average queue length of a defined traffic type from a plurality of traffic types at the first traffic junction based on the piece-wise sinusoidal representation for the plurality of traffic types.

2. The system of claim 1, further comprising:

generating, by the system, a parameter to vary the offset, utilizing the multi-variate polynomial describing average queue length of traffic at the traffic junction and a polynomial objective, wherein the polynomial objective distinguishes between the defined traffic type and a second defined traffic type from the plurality of traffic types and between queue lengths, delays relative to a time table, or delays relative to a fastest possible journey.

3. The system of claim 1, wherein the defined traffic type is a traffic type selected from a group consisting of a car, a bus, a bicycle, a motorcycle, an emergency vehicle, a truck, a tram, a trolley, and a train.

4. A non-transitory computer program product for controlling traffic, the computer program product comprising a computer readable storage medium having program instructions embodied therewith, the program instructions executable by a processor to cause the processor to:

generate a piece-wise sinusoidal representation of traffic arrival at a first traffic junction;

determine an offset between a first parameter of the first traffic junction and a second parameter of a second traffic junction based on the piece-wise sinusoidal representation, wherein the first parameter is a start of a first phase sequence and the second parameter is another start of a second phase sequence; and generate a multi-variate polynomial describing an average queue length of traffic at the first traffic junction over a phase sequence based on the piece-wise sinusoidal representation, and wherein the determining is based on the generated multi-variate polynomial.

5. The non-transitory computer program product of claim 4, wherein the program instructions further cause the processor to generate a control directive to minimize a polynomial objective by varying the offset, wherein the first parameter is a start of a phase sequence at the first traffic junction and the second parameter is a start of a phase sequence at the second traffic junction, the offset being a difference between the start of the phase sequence at the first traffic junction and the start of the phase sequence at the second traffic junction, and the control directive alters the start of the phase sequence at the first traffic junction and the start of the phase sequence at the second traffic junction, to alter the offset.

6. The non-transitory computer program product of claim 4, wherein the traffic is a first traffic type selected from a group consisting of a car, a bus, a bicycle, a motor cycle, a truck, an emergency vehicle, a tram, a trolley, and a train.

7. The non-transitory computer program product of claim 4, wherein the multi-variate polynomial distinguishes between a first average queue length of a first traffic type at the first traffic junction over the first phase sequence and a second average queue length of a second traffic type at the first traffic junction over the first phase sequence.

8. The non-transitory computer program product of claim 4, wherein the multi-variate polynomial further describes a time delay of the traffic at the first traffic junction over the first phase sequence.

9. The non-transitory computer program product of claim 4, wherein the first traffic junction comprises a traffic route and the first phase sequence comprises a first period in which the traffic route is prohibited to traffic and a second period in which the traffic route is permitted to the traffic.

10. The non-transitory computer program product of claim 5, wherein the program instructions further cause the processor to communicate with the first traffic junction and the second traffic junction via a cloud environment.

11. The non-transitory computer program product of claim 4, wherein the multi-variate polynomial further describes a polynomial objective that indicates a traffic type priority.

12. The non-transitory computer program product of claim 4, wherein the program instructions further cause the processor to control one or more devices at the first traffic junction based on the first parameter and the second parameter.

* * * * *